US010706690B2

(12) United States Patent
Marks

(10) Patent No.: US 10,706,690 B2
(45) Date of Patent: Jul. 7, 2020

(54) METHOD OF GAMING, A GAME CONTROLLER AND A GAMING SYSTEM

(71) Applicant: Aristocrat Technologies Australia Pty Limited, North Ryde (AU)

(72) Inventor: Daniel Marks, Decatur, GA (US)

(73) Assignee: ARISTOCRAT TECHNOLOGIES AUSTRALIA PTY LIMITED, North Ryde (AU)

( * ) Notice: Subject to any disclaimer, the term of this patent is extended or adjusted under 35 U.S.C. 154(b) by 184 days.

(21) Appl. No.: 14/822,976

(22) Filed: Aug. 11, 2015

(65) Prior Publication Data

US 2016/0042596 A1 Feb. 11, 2016

(30) Foreign Application Priority Data

Aug. 11, 2014 (AU) ..... 2014903126

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01)

(58) Field of Classification Search
CPC ..... G07F 17/3244; G07F 17/34
USPC ..... 463/21
See application file for complete search history.

(56) References Cited

U.S. PATENT DOCUMENTS 7,562,873 B1 * 7/2009 Luciano, Jr. ..... G07F 17/32 273/139
2008/0113735 A1 * 5/2008 Maya ..... G07F 17/32 463/20
2010/0029366 A1 * 2/2010 Roukis ..... G07F 17/3262 463/20
2015/0348355 A1 12/2015 Caputo et al.

OTHER PUBLICATIONS

Australian Examination Report for AU2018278872, dated Sep. 23, 2019, 3 pages.

* cited by examiner

*Primary Examiner* — David L Lewis
*Assistant Examiner* — Robert E Mosser
(74) *Attorney, Agent, or Firm* — McAndrews, Held & Malloy, Ltd.

(57) ABSTRACT

An electronic method of gaming comprising an electronic game controller: selecting, for each of at least one display area of a symbol display, a plurality of symbols for display at respective ones of a plurality of display positions arranged in the display area; evaluating the selected symbols to determine whether or not the selected symbols for display at at least two designated display positions are the same; upon determining that the selected symbols for display at at least two designated display positions are the same, applying a modification to each of the selected symbols for display at the at least two designated display positions to form a modified symbol display; and evaluating the modified symbol display to make an award.

20 Claims, 7 Drawing Sheets

METHOD OF GAMING, A GAME CONTROLLER AND A GAMING SYSTEM

RELATED APPLICATIONS

This application claims priority to Australian Provisional Patent Application No. 2014903126 having an International filing date of Aug. 11, 2014, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

There exists gaming machines where more than one game may be played at the same time. Such gaming machines allow players to play multiple different games at the same gaming machine.

While such gaming machines provide players with enjoyment, a need exists for alternative gaming systems in order to maintain or increase player enjoyment.

BRIEF SUMMARY OF THE INVENTION

In a first aspect, the invention provides an electronic method of gaming comprising an electronic game controller:

selecting, independently for each of at least one display area of a symbol display, a plurality of symbols for display at respective ones of a plurality of display positions arranged in the display area;

evaluating the selected symbols to determine whether or not the selected symbols for display at at least two designated display positions are the same;

upon determining that the selected symbols for display at at least two designated display positions are the same, applying a modification to each of the selected symbols for display at the at least two designated display positions to form a modified symbol display; and evaluating the modified symbol display to make an award.

In an embodiment, there are multiple display areas, and the symbols are selected independently for each of the display areas.

In an embodiment, the display areas are on separate ones of a plurality of displays.

In an embodiment, the display areas are on the same display.

In an embodiment, the designated display positions are arranged in separate ones of the display areas.

In an embodiment, each designated display position is arranged in a respective one of the separate display areas.

In an embodiment, the display positions of each display area correspond to respective ones of the display positions of each of the other display areas.

In an embodiment, the display positions of each display area correspond to respective ones of the display positions of each of the other display areas, and each designated display position of each display area corresponds to a respective designated display position of each of the other display areas.

In an embodiment, evaluating the selected symbols to determine whether or not the selected symbols for display at the at least two designated display positions are the same comprises evaluating the selected symbols to determine whether or not the selected symbols for display at corresponding designated display positions are the same.

In an embodiment, applying a modification to each of the selected symbols for display at the at least two designated display positions comprises applying a modification to each of the selected symbols for display at the corresponding designated display positions where the selected symbols for display are the same.

In an embodiment, each designated display position is a corner position of a display area.

In an embodiment, evaluating the selected symbols comprises comparing the selected symbols for display at the designated display positions.

In an embodiment, applying the modification to each of the selected symbols comprises modifying each of the selected symbols to a function symbol.

In an embodiment, the function symbol is a WILD symbol.

In an embodiment, the function symbol is a multiplier.

In a second aspect, the invention provides an electronic method of gaming comprising an electronic game controller:

selecting, for each of a sequence of game instances, a plurality of symbols for display at respective ones of a plurality of display positions arranged in a symbol display on a display;

evaluating the selected symbols to determine whether or not the selected symbols for the sequence of game instances are the same at at least one designated display position arranged in the symbol display on the display;

upon determining that the selected symbols for the sequence of game instances are the same at at least one designated display position, applying a symbol modification in respect of each of the at least one designated display position for at least one of the game instances to form a modified symbol display for each of the at least one game instance; and evaluating each modified symbol display to make an award.

In an embodiment, the at least one game instance in respect of which the symbol modification is applied comprises the last one of the sequence of game instances.

In an embodiment, each designated display position is a corner position of the display area.

In an embodiment, evaluating the selected symbols comprises comparing the selected symbols for the sequence of game instances at the at least one designated display position.

In an embodiment, applying the symbol modification in respect of each designated display position comprises modifying the selected symbol for display at the designated display position to a function symbol.

In an embodiment, the function symbol is a WILD symbol.

In an embodiment, the function symbol is a multiplier.

In a third aspect, the invention provides a game controller for a gaming system, the game controller arranged to:

select, for each of at least one display area of a symbol display, a plurality of symbols for display at respective ones of a plurality of display positions arranged in the display area;

evaluate the selected symbols to determine whether or not the selected symbols for display at at least two designated display positions are the same;

upon determining that the selected symbols for display at at least two designated display positions are the same, apply a modification to each of the selected symbols for display at the at least two designated display positions to form a modified symbol display; and evaluate the modified symbol display to make an award.

In a fourth aspect, the invention provides a game controller for a gaming system, the game controller arranged to:

select, independently for each of a plurality of display areas of a symbol display, a plurality of symbols for display at respective ones of a plurality of display positions arranged in the display area;

evaluate the selected symbols to determine whether or not the selected symbols for display at at least two designated display positions are the same;

upon determining that the selected symbols for display at at least two designated display positions are the same, apply a modification to each of the selected symbols for display at the at least two designated display positions to form a modified symbol display; and evaluate the modified symbol display to make an award.

In a fifth aspect, the invention provides a game controller for a gaming system, the game controller arranged to:

select, for each of a sequence of game instances, a plurality of symbols for display at respective ones of a plurality of display positions arranged in a symbol display on a display;

evaluate the selected symbols to determine whether or not the selected symbols for the sequence of game instances are the same at at least one designated display position arranged in the symbol display on the display;

upon determining that the selected symbols for the sequence of game instances are the same at at least one designated display position, apply a symbol modification in respect of each of the at least one designated display position for at least one of the game instances to form a modified symbol display for each of the at least one game instance; and evaluate each modified symbol display to make an award.

In a sixth aspect, the invention provides a gaming system comprising:

a display comprising at least one display area of a symbol display;

a symbol selector arranged to select, for each display area, a plurality of symbols for display at respective ones of a plurality of display positions arranged in the display area;

a symbol matcher arranged to evaluate the selected symbols to determine whether or not the selected symbols for display at at least two designated display positions are the same;

a symbol modifier arranged to, upon the symbol matcher determining that the selected symbols for display at at least two designated display positions are the same, apply a modification to each of the selected symbols for display at the at least two designated display positions to form a modified symbol display; and a prize awarder arranged to evaluate the modified symbol display to make an award.

In a seventh aspect, the invention provides a gaming system comprising:

a display comprising a plurality of display areas of a symbol display;

a symbol selector arranged to select, independently for each display area, a plurality of symbols for display at respective ones of a plurality of display positions arranged in the display area;

a symbol matcher arranged to evaluate the selected symbols to determine whether or not the selected symbols for display at at least two designated display positions are the same;

a symbol modifier arranged to, upon the symbol matcher determining that the selected symbols for display at at least two designated display positions are the same, apply a modification to each of the selected symbols for display at the at least two designated display positions to form a modified symbol display; and a prize awarder arranged to evaluate the modified symbol display to make an award.

In an eighth aspect, the invention provides a gaming system comprising:

a plurality of displays comprising respective ones of a plurality of display areas of a symbol display;

a symbol selector arranged to select, independently for each display area, a plurality of symbols for display at respective ones of a plurality of display positions arranged in the display area;

a symbol matcher arranged to evaluate the selected symbols to determine whether or not the selected symbols for display at at least two designated display positions are the same;

a symbol modifier arranged to, upon the symbol matcher determining that the selected symbols for display at at least two designated display positions are the same, apply a modification to each of the selected symbols for display at the at least two designated display positions to form a modified symbol display; and a prize awarder arranged to evaluate the modified symbol display to make an award.

In a ninth aspect, the invention provides a gaming system comprising:

a display;

a symbol selector arranged to select, for each of a sequence of game instances, a plurality of symbols for display at respective ones of a plurality of display positions arranged in a symbol display on the display;

a symbol matcher arranged to evaluate the selected symbols to determine whether or not the selected symbols for the sequence of game instances are the same at at least one designated display position arranged in the symbol display on the display;

a symbol modifier arranged to, upon the symbol matcher determining that the selected symbols for the sequence of game instances are the same at at least one designated display position, apply a symbol modification in respect of each of the at least one designated display position for at least one of the game instances to form a modified symbol display for each of the at least one game instance; and a prize awarder arranged to evaluate each modified symbol display to make an award.

The invention also provides computer program code which when executed by components of a controller of a gaming system implements any one of the above methods.

The invention also provides a tangible computer readable medium comprising the above computer program code.

BRIEF DESCRIPTION OF SEVERAL VIEWS OF THE DRAWINGS

An exemplary embodiment of the invention will now be described with reference to the accompanying drawings in which.

DETAILED DESCRIPTION OF THE INVENTION

Figure 1:
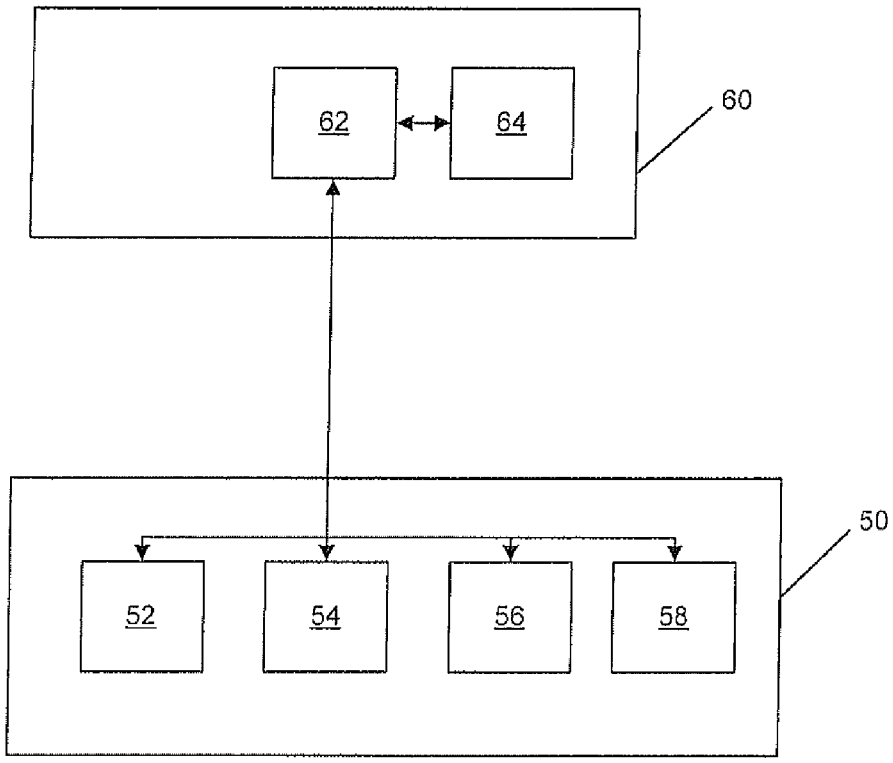
FIG. 1 is a block diagram of the core components of a gaming system.

Referring to the drawings, there is shown an electronic gaming system having a game controller 60 arranged to select a plurality of symbols for display at respective ones of a plurality of display positions. In a first embodiment, the symbols are selected for display at each of at least one display area, and the game controller 60 evaluates the selected symbols to determine whether or not the selected symbols for display at at least two designated display positions are the same. Upon determining that the selected symbols for display at the at least two designated display positions are the same, the game controller 60 applies a modification to each of the selected symbols for display at the at least two designated display positions to form a modified symbol display, and evaluates the modified symbol display to make an award. In a second embodiment, the symbols are selected for display at each of a sequence of game instances, and the game controller 60 evaluates the selected symbols to determine whether or not the selected symbols for the sequence of game instances are the same at at least one designated display position. Upon determining that the selected symbols for the sequence of game instances are the same at the at least one designated display position, the game controller 60 applies a symbol modification in respect of each of the at least one designated display position for at least one of the game instances to form a modified symbol display for each of the at least one game instance, and evaluates each modified symbol display to make an award In the second embodiment, the selected symbols for each gaming instance may be displayed on either the same display or separate ones of a plurality of displays depending on the embodiment. Similarly, it is envisaged that in the first embodiment, if there are multiple display areas, the display areas may be provided either on the same display or on separate ones of a plurality of displays.

General Construction of Gaming System

The gaming system can take a number of different forms. In a first form, a stand-alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand-alone gaming machine mode, "thick client" mode or "thin client" mode depending on the game being played, operating conditions, and so on. Other variations will be apparent to persons skilled in the art.

Irrespective of the form, the gaming system has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also known to provide a specific purpose processor using an application specific integrated circuit (ASIC) or a field programmable gate array (FPGA).

Figure 2:
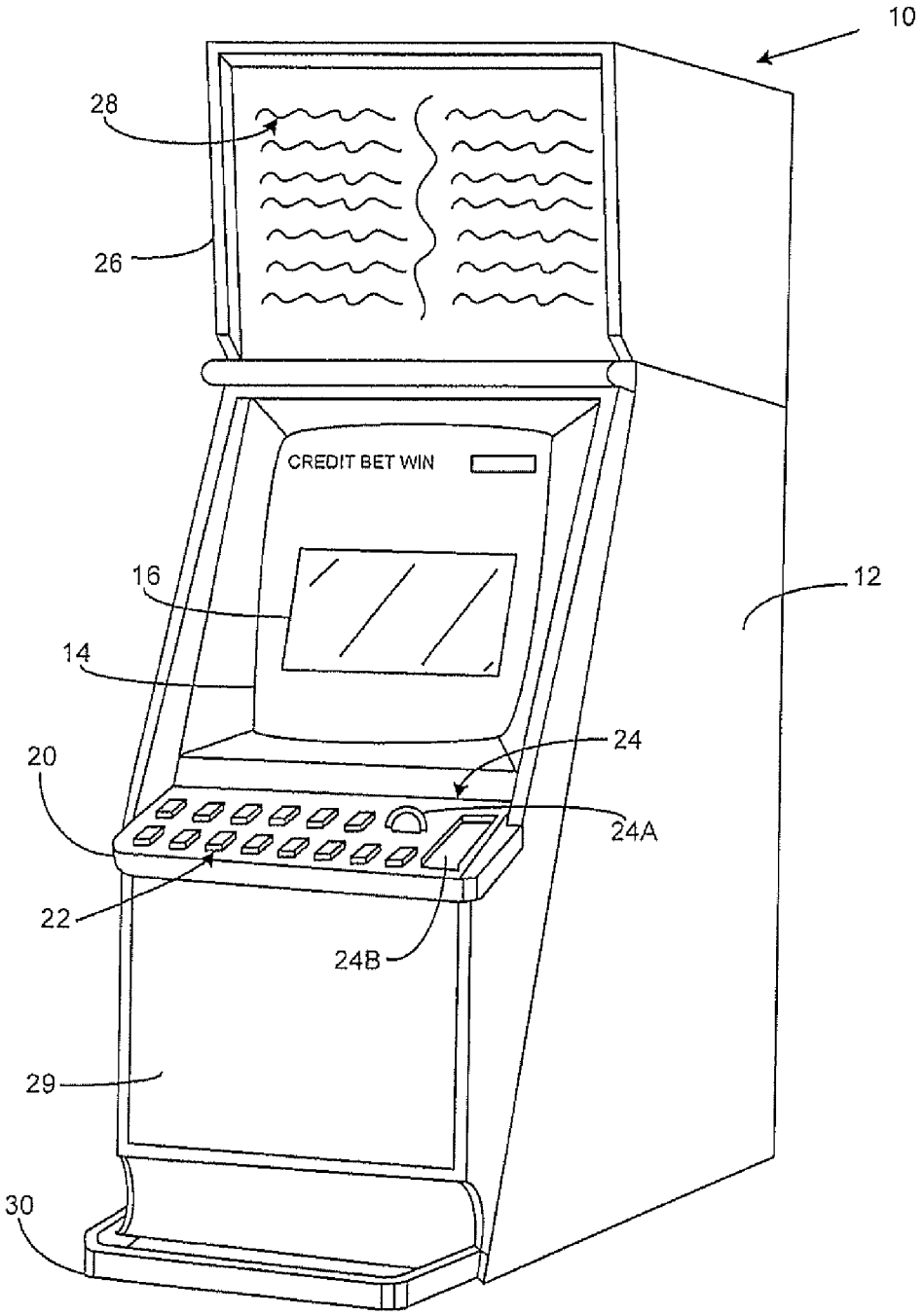
FIG. 2 is a perspective view of a stand alone gaming machine.

A gaming system in the form of a stand-alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticket. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
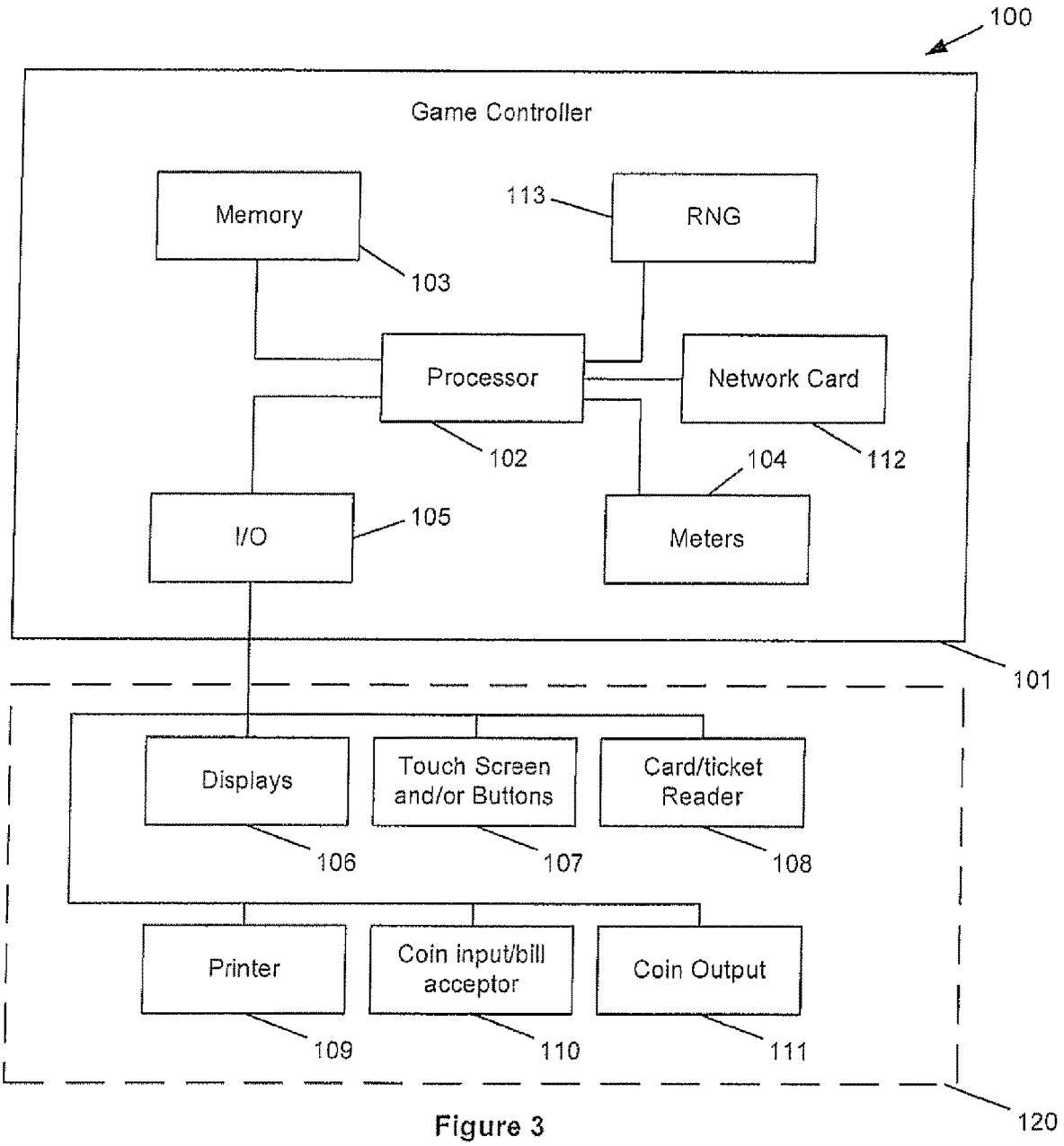
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
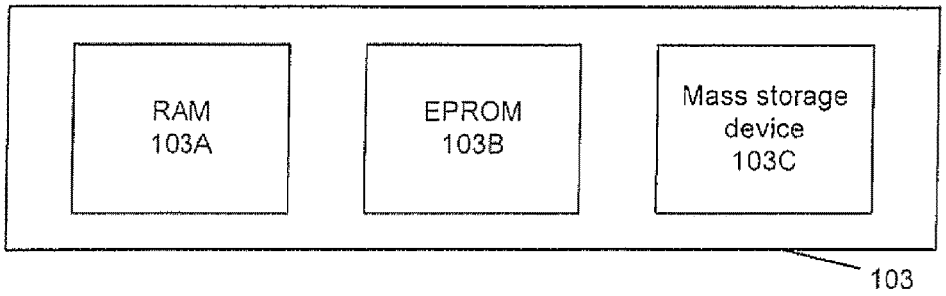
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
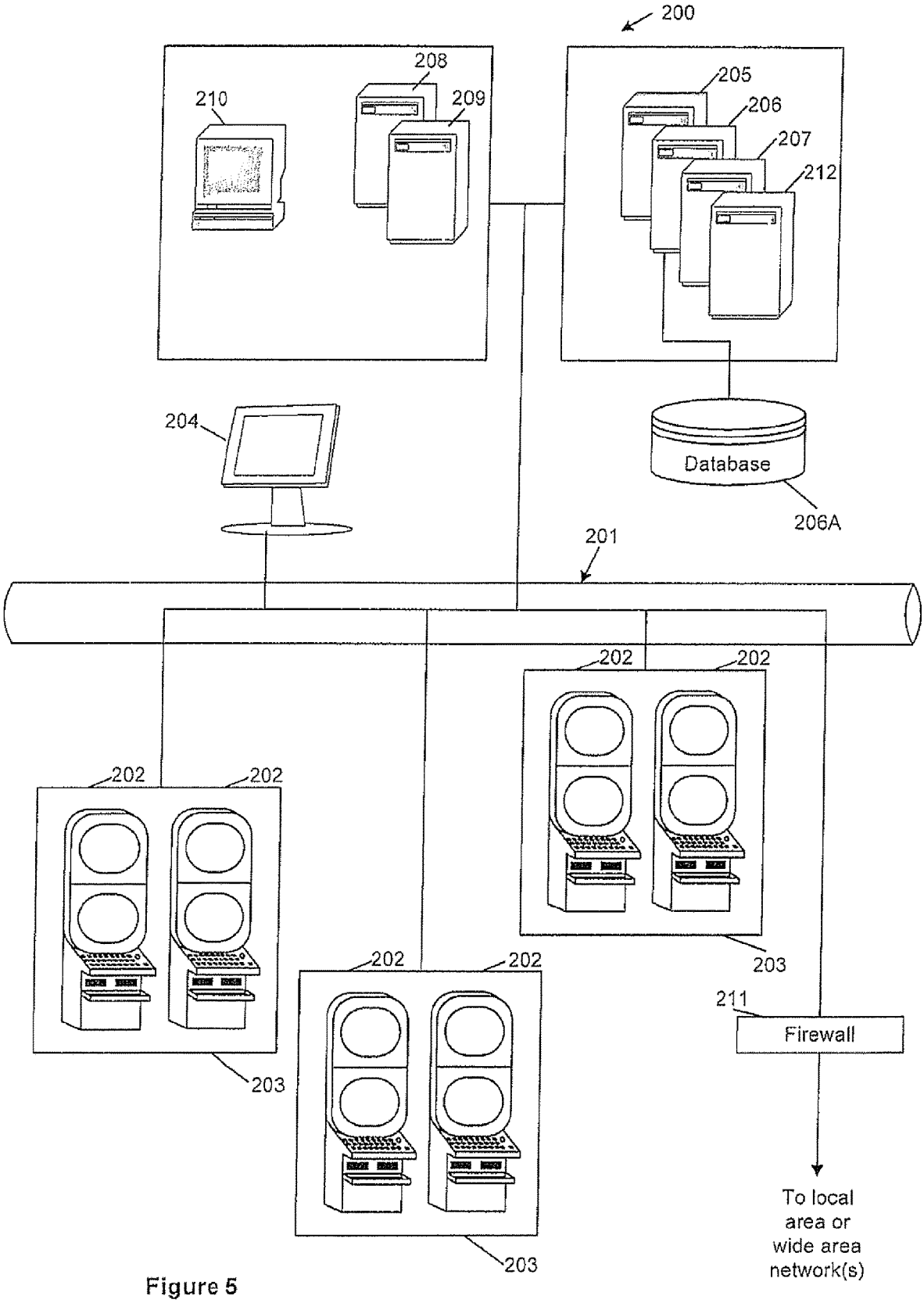
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

In order to participate in the game, the player operates the game play mechanism 56 to specify a wager and hence win entitlements which will be evaluated for this play of the game and initiates a play of the game. Persons skilled in the art will appreciate that a player's win entitlement will vary from game to game dependent on player selections. In most spinning reel games, it is typical for the player's entitlement to be affected by the amount they wager and selections they make (i.e. the nature of the wager). For example, a player's win entitlement may be based on how many lines they play in each game—e.g. a minimum of one line up to the maximum number of lines allowed by the game (noting that not all permutations of win lines may be available for selection) and how much they wager per line. Such win lines are typically formed by a combination of symbol display positions, one from each reel, the symbol display positions being located relative to one another such that they form a line.

In many games, the player's win entitlement is not strictly limited to the lines they have selected, for example, "scatter" pays are awarded independently of a player's selection of pay lines and are an inherent part of the win entitlement.

Persons skilled in the art will appreciate that in other embodiments, the player may obtain a win entitlement by selecting a number of reels to play and an amount to wager per reel. Such games are marketed under the trade name "Reel Power" by Aristocrat Leisure Industries Pty Ltd. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the centre row are used for non-selected reels. The total number of ways to win is determined by multiplying the number of active display positions of each reels, the active display positions being all display positions of each selected reel and the designated display position of the non-selected reels. As a result for five reels and fifteen display positions there are 243 ways to win.

In other embodiments a player win entitlement may be affected by purchasing access to particular pay tables—e.g. a first bet amount entitles the player to wins including cherry symbols and a second amount entitles them to wins including plum symbols.

Figure 6:
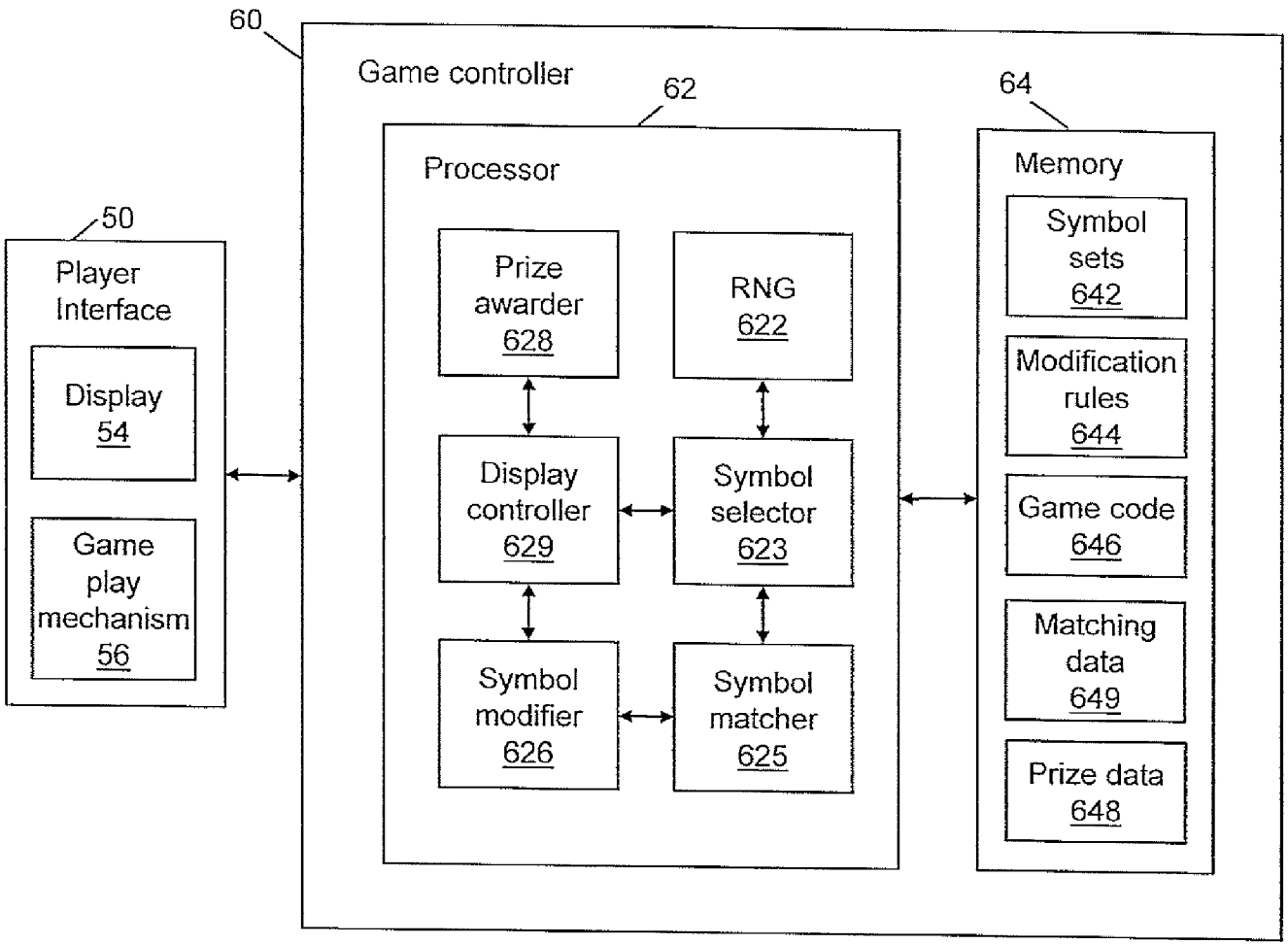
FIG. 6 is a further block diagram of a gaming system.

In FIG. 6, the processor 62 of the game controller 60 is shown implementing a number of modules based on program code and data stored in memory 64. These modules include a symbol selector 623, a symbol matcher 625, a symbol modifier 626 and a prize awarder 628. Persons skilled in the art will appreciate that one or more of the modules could be implemented in some other way, for example by a dedicated circuit.

As indicated above, depending on the embodiment, the game controller 60 may be arranged to select a plurality of symbols for display at respective ones of a plurality of display positions for each of at least one display area, and/or a plurality of symbols for display at respective ones of a plurality of display positions for each of at least one display area for a sequence of game instances.

In the first embodiment where symbols are selected for display at each of at least one display area, the symbol selector 623 operates in response to a player's operation of the game play mechanism 56 to place a wager and initiate a play of a game. In this embodiment, there are multiple display areas arranged in a symbol display on the display 54, and the symbol selector 623 initiates play of a game by selecting, independently for each of the display areas of the symbol display provided by the display 54, a set or plurality of symbols for display at respective ones of a plurality of display positions arranged in the respective one of the display areas. When in use, the symbol selector 623 selects the symbols for display based on random numbers (or pseudo-random numbers) generated by a random number generator (RNG) 622 implemented by the processor 62 and symbols sets 642 stored in the memory 64 of the game controller 60, and a display controller 629 implemented by the processor 62 controls the display 54 to display the selected symbols on each of the display areas of the symbol display. In this embodiment, the display areas of the symbol display are provided on the same display 54. However, as indicated above, it is envisaged that the display areas of the symbol display may alternatively be provided on separate ones of a plurality of displays in an alternative embodiment. In such an alternative embodiment, the processor 62 may implement separate display controllers for controlling the separate displays. Also, it is envisaged that, in an alternative embodiment, the display areas of the symbol display may alternatively be on the respective displays of separate gaming machines comprising separate game controllers comprising separate processors implementing separate modules (such as separate symbols selectors and/or separate display controllers), and separate games may be played at the separate gaming machines.

As indicated above, there are multiple display areas in the symbol display and the display areas of the symbol display are provided on the same display 54. In this embodiment, the display positions of the display areas of the symbol display respectively correspond to one another. That is, the display areas of the symbol display are essentially replicas of one another, and the display positions of any one of the display areas of the symbol display correspond to respective ones of the display positions of any one of the other display areas of the symbol display. It is however envisaged that this need not be the case in an alternative embodiment. For example, in an alternative embodiment, there may be more display positions arranged in a first one of the display areas when compared to another a second of the display areas, and/or that one, more or all of the display positions of the first display area may not correspond to any one of the display positions of the second display area.

After the selection of symbols by the symbol selector 623, the symbol matcher 625 evaluates the symbols selected by the symbol selector 623 to determine whether or not the selected symbols for display at at least two designated display positions are the same. In use, the symbol matcher 625 evaluates the selected symbols based on matching data 649 in respect of this first embodiment stored in the memory 64. Specifically, the symbol matcher 625 compares the selected symbols for display at the designated display positions, and determines that the selected symbols for display at the designated display positions are the same (that is, if the selected symbols for display at at least two of the designated display positions are the same). Depending on the embodiment, the plurality of designated display positions may be predetermined in the game code 646 stored in the memory 64 or designated by a player before initiation of game play.

As indicated above, the display areas of the symbol display are essentially replicas of one another and the display positions of any one of the display areas correspond to respective ones of the display positions of any one of the other display areas. In this embodiment, there are two designated display positions in each display area, and each of the two designated display positions in each display area corresponds to a respective designated display position of each of the other display areas. However, it is envisaged that this need not be the case. For example, in an alternative embodiment, there may be only one designated display position in each display area, and the designated display positions may be arranged in respective ones of the separate display areas provided on the display 54. In such an alternative embodiment, the number of designated display positions is the same as the number of display areas. In yet another embodiment, the designated display position or positions may be arranged in just one or more of the display areas of the symbol display and there may be no designated display position or positions in one or more of the other display areas.

Also, the designated display positions in this embodiment are located at the upper and lower right corners of each display area. That is, each designated display position of a display area is located at the same corner position as the corresponding designated display position of another display area. It is envisaged that, in an alternative embodiment, one or more the designated display positions may not be a display position at a corner of a display area, but in another location of the display area.

Upon the symbol matcher 625 determining that the selected symbols for display at at least two designated display positions are the same, the symbol modifier 626 applies a modification to each of the selected symbols for display at the at least two designated display positions to form a modified symbol display. The symbol modifier 626 applies the modification based on modification rules 644 in respect of this first embodiment stored in the memory 64. In this embodiment, the modification is to modify each symbol for display at each of the at least two designated display positions to a function symbol such as a WILD symbol or a multiplier. It is however envisaged that the modification may be any type of enhanced outcome and is not limited to just symbol modification. For example, the modification may be to award free games in an alternative embodiment. In yet another embodiment, the modification may be to make progressive awards.

Finally, the prize awarder 628 evaluates the modified symbol display upon the symbol modifier 626 applying a modification to each of the selected symbols for display at the at least two designated display positions. Depending on the result of the evaluation, the prize awarder 628 may make one or more awards. For example, the prize awarder 628 may make an award if the prize awarder 628 evaluates the modified symbol display and determines that there is a winning symbol combination in the modified symbol display. When in use, the prize awarder 628 makes the one or more awards based on the prize data 648 stored in the memory 64.

Turning now to the second embodiment, this second embodiment is similar to the first embodiment in that there is a selection of multiple sets of symbols for display. However, in contrast to the first embodiment where each plurality of symbols is selected for display for a respective one of a plurality of display areas, each plurality of symbols in this second embodiment is selected for display for a respective one of a plurality of game instances (more specifically, a sequence of one or more game instances).

In this second embodiment where symbols are selected for display at each of a sequence of game instances, the symbol selector 623 initiates play of a game by selecting, for each game instance, a set or plurality of symbols for display at respective ones of a plurality of display positions arranged in a symbol display on the display 54. In this respect, it is noted that the symbol display of this second embodiment comprises only one set of selected symbols, but it is envisaged that there may be multiple sets of selected symbols corresponding to multiple display areas in the symbol display in an alternative embodiment. As with the first embodiment, the symbols are selected based on random numbers generated by the RNG 622 and the symbol sets 642 stored in the memory, and the display controller 629 controls the display 54 to display the selected symbols. In this embodiment, the game instances occur on the same device, and the selected symbols for each game instance are displayed on the same display 54. However, it is envisaged that, in an alternative embodiment, the game instances may alternatively occur on different devices and that the selected symbols for each game instance may alternatively be displayed on separate displays. Also, the selected symbols are displayed on the display 54 after selection for each game instance in this embodiment. However, it is envisaged that this need not be the case. For example, in an alternative embodiment, only the selected symbols for the last game instance may be displayed on the display 54.

After the selection of symbols, the symbol matcher 625 evaluates the symbols selected by the symbol selector 623 for the sequence of game instances to determine whether or not the selected symbols for the sequence of game instances are the same at at least one designated display position arranged in the symbol display on the display 54. When in use, the symbol matcher 625 evaluates the selected symbols based on the matching data 649 in respect of this second embodiment stored in the memory 64. That is, the symbol matcher 625 compares the symbols selected for display at each designated display position for the sequence of game instances to determine whether the same symbol is previously selected for display at the designated display position. Put another way, the symbol matcher 625 compares the symbols between one or more consecutive game instances to determine whether or not the same symbols are displayed at the designated display positions. Each designated display position may be any display position arranged in the symbol display. For example, each designated display position may be one of the corner positions. As with the first embodiment, the designated display position or positions may be predetermined in the game code 646 stored in the memory 64. Alternatively, the designated display position or positions may be designated by the player before initiation of game play.

As indicated above, the game instances occur on the same device, and the selected symbols for each game instance are displayed on the same display 54. Thus, the display positions for the sequence of game instances are essentially replicas of one another and the display positions (including designated display position or positions) for any one of the sequence of game instances correspond to respective ones of the display positions for any one of the other game instances. However, it is envisaged that, in an alternative embodiment where the game instances occur on different devices and the selected symbols for each game instance are displayed on separate displays, the designated display position or positions for different game instances may not correspond to one another.

Upon the symbol matcher 625 determining that the selected symbols for the sequence of game instances are the same at at least one designated display position, the symbol modifier 626 applies a symbol modification in respect of each of the at least one designated display position for at least one of the game instances to form a modified symbol display for each of the at least one game instance. The symbol modifier 626 applies the modification based on modification rules 644 in respect of this second embodiment stored in the memory 64. In this embodiment, symbol modification in respect of each designated display position is applied for only the last one of the game instances, and thus a modified symbol display is formed for only the last one of the sequence of game instances. For example, if there are two game instances, a modified symbol display may be formed for only the second one of the two game instances. If there are three game instances, a modified symbol display may be formed for only the third one of the three game instances.

Like in the first embodiment, the modification in this second embodiment is to modify each symbol for display at each designated display position to a function symbol (which as indicated above may be a WILD symbol, a multiplier etc.), but it is envisaged that the modification may be any enhanced outcome (which as indicated above may include providing free games, progressive awards etc.).

Finally, upon the symbol modifier 626 applying a symbol modification in respect of each designated display position for the last game instance to form a modified symbol display for the last game instance, the prize awarder 628 evaluates the modified symbol display to make one or more awards, for example, if there is a winning symbol combination in the modified symbol display. As with the first embodiment, the prize awarder 628 makes the one or more awards based on the prize data 648 stored in the memory 64. In this embodiment, awards are only made to the modified symbol display. However, it is envisaged that award(s) may also be made in respect of any unmodified symbol display (such as the original symbol display formed by the symbols selected for display at each game instance prior to modification) in an alternative embodiment.

Figure 7:
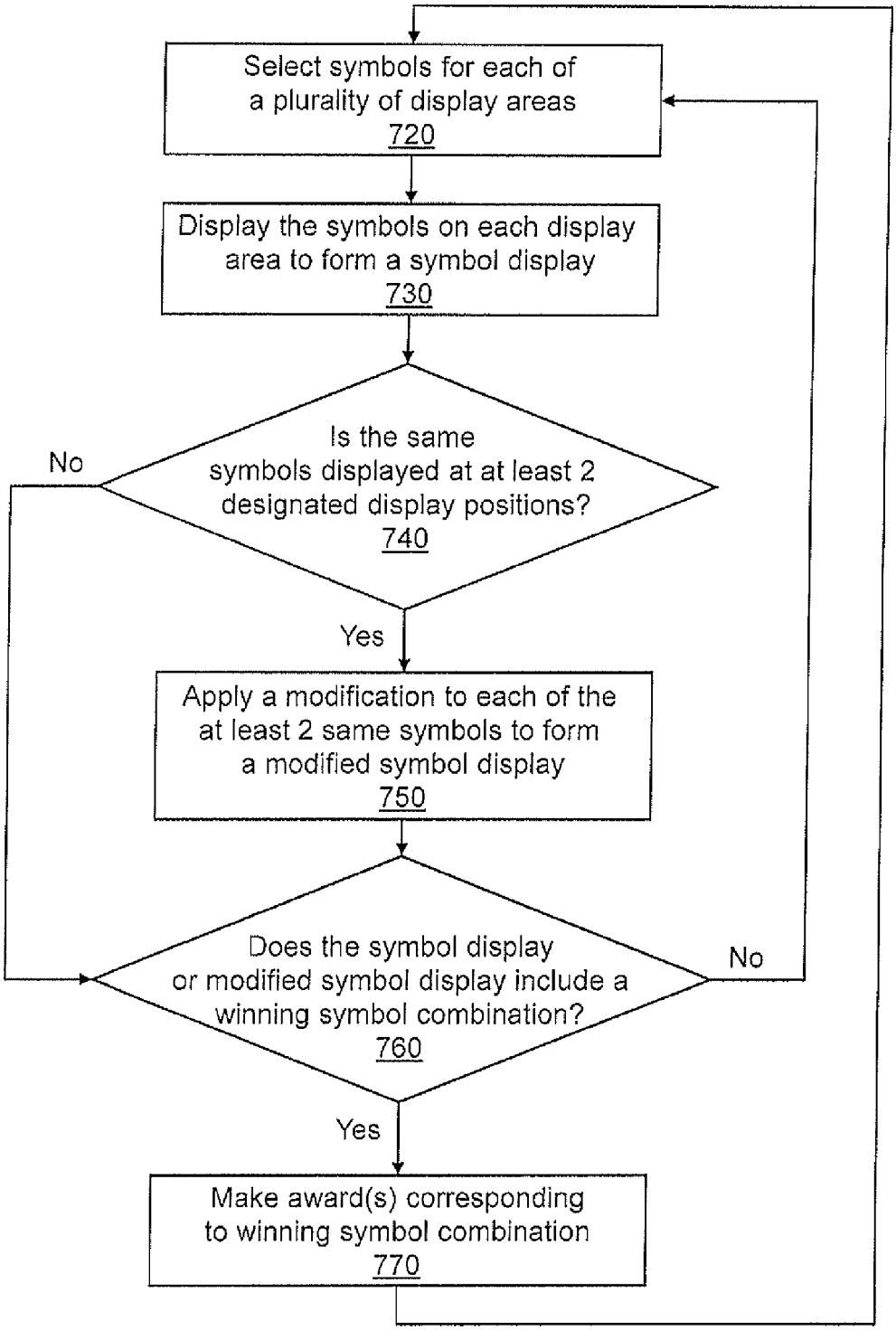
FIG. 7 is a flow chart of a method of gaming.

In FIG. 7, there is shown a flowchart of a method of gaming in respect of the first embodiment where symbols are selected for display at each of at least one display area. At step 720, game play starts when a player places a wager and initiates a play of a game where symbols are selected by the symbol selector 623 based on random numbers from the RNG 622 and the symbol sets 642 stored in the memory 64. As indicated above, the symbols are independently selected by the symbol selector 623 for each of the plurality of display areas of the symbol display.

At step 730, the display controller 629 controls the display 54 to display the selected symbols at each of the plurality of display areas to form a symbol display. More specifically, the display controller 629 controls the display 54 to display, for each one of the display areas on the display 54, the selected symbols at respective ones of a plurality of display positions arranged in a respective one of the display areas. As indicated above, there are multiple display areas in the symbol display in this embodiment, but it is envisaged that there may be only one display area in an alternative embodiment. Also, in this embodiment, the display areas of the symbol display are provided on the same display 54, but it is envisaged that multiple displays may be used in an alternative embodiment. In this embodiment, symbols are displayed by the display 54 prior to symbol modification by the symbol modifier 626. However, it is envisaged that, in an alternative embodiment, the display controller 629 may control the display 54 to display symbols only after modification by the symbol modifier 626.

At step 740, the symbol matcher 625 evaluates the symbols selected by the symbol selector 623 for display at at least two designated display positions of the display areas to determine whether or not the same symbols are displayed at the at least two designated display positions. As indicated above, the designated display positions are located at the upper and lower right corners of respective ones of the display areas in this embodiment, but it is envisaged that this need not be the case in an alternative embodiment. If different symbols are displayed at the designated display positions, the prize awarder 628 evaluates the symbol display to determine whether or not there is a winning symbol combination or combinations in the symbol display at step 760 and makes one or more awards corresponding to the winning symbol combination or combinations at step 770 if there is a winning symbol combination or combinations in the symbol display.

Otherwise, if the same symbols are displayed at the at least two designated display positions, the symbol modifier 626 applies a modification to each of the selected symbols displayed at the at least two designated display positions on the display 54 to form a modified symbol display at step 750. Then, at step 760, the prize awarder 628 evaluates the modified symbol display to determine whether or not there is a winning symbol combination or combinations in the modified symbol display. If so, the prize awarder 628 makes one or more awards corresponding to the winning symbol combination or combinations at step 770.

Figure 8:
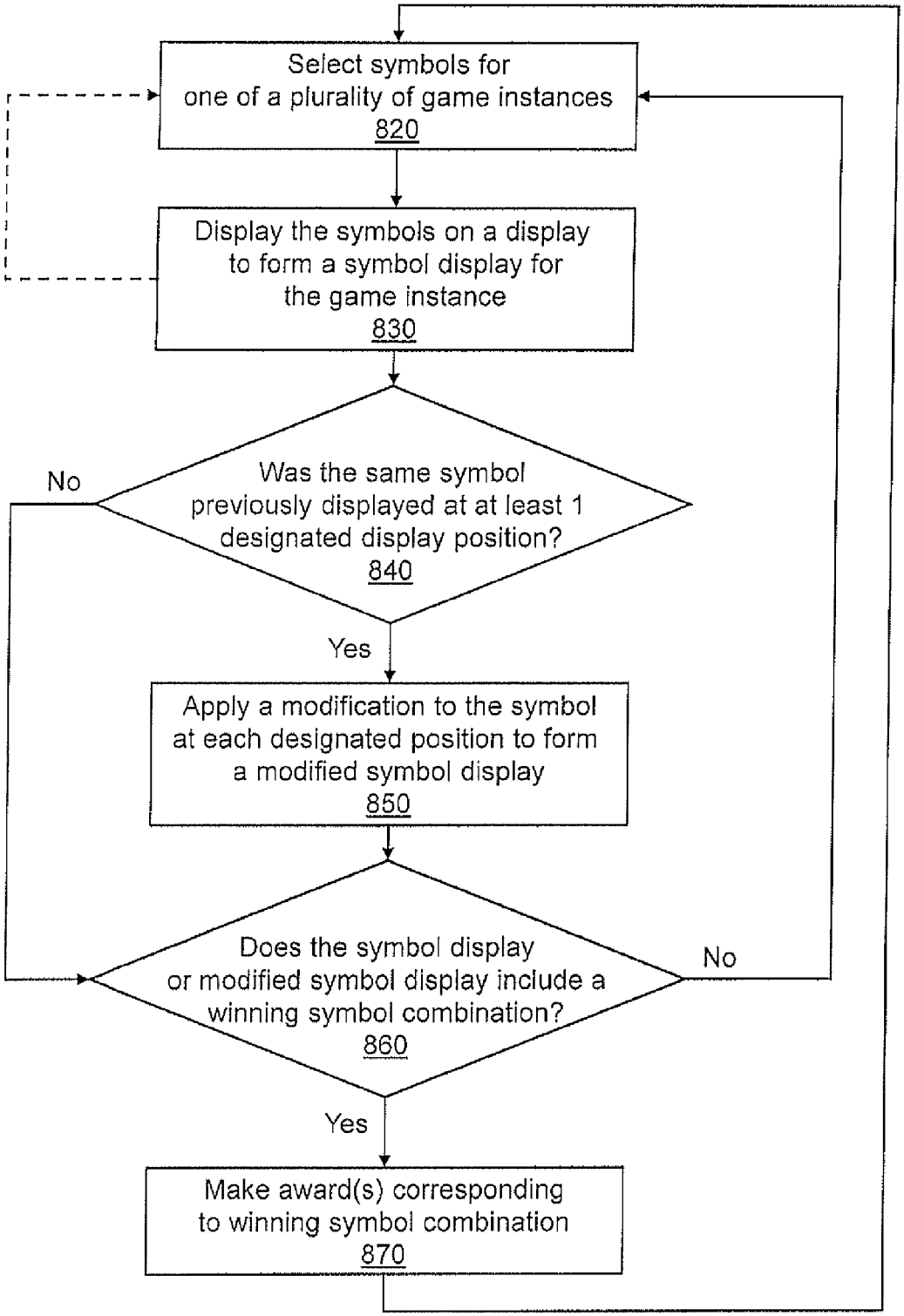
FIG. 8 is a flow chart of another method of gaming.

FIG. 8 illustrates a flowchart of the method of gaming in respect of the second embodiment where symbols are selected for display at each of a sequence of game instances. At step 820, a player places a wager and initiates a play of a game, and the symbol selector 623 selects a plurality of symbols for display on the display 54 for a first one of the sequence of game instances. As with the first embodiment, the symbols are selected by the symbol selector 623 based on random numbers generated by the RNG 622 and the symbol sets 642 stored in the memory 60. At step 830, the symbols selected by the symbol selector 623 for the first game instance is displayed on the respective display positions on the display 54. As this is the first one of the sequence of game instances, the symbol selector 623 again selects a plurality of symbols for display on the display 54 for another one of the sequence of game instances at step 820, and the symbols selected by the symbol selector 623 for this next game instance are again displayed on the respective display positions on the display 54 at step 830. As indicated above, the selected symbols for each of the sequence of game instances are displayed on the display 54 in this embodiment, but it is envisaged that the selected symbols for only one of the sequence of game instances are displayed on the display 54 in an alternative embodiment.

At step 840, after symbols have been selected and displayed for the entire sequence of game instances, the symbol matcher 625 evaluates the symbols selected by the symbol selector 623 for the sequence of game instances to determine whether or not the selected symbols for the sequence of game instances are the same at at least one designated display position arranged in the symbol display on the display 54. That is, the symbol matcher 625 evaluates the symbols to determine whether the same symbol was displayed at each designated display position for the sequence of game instances.

If the symbol matcher 625 determines that no same symbol was displayed at each designated display position for the sequence of game instances, at step 860, the prize awarder 628 evaluates the displayed symbols to determine whether there is a winning symbol combination or combinations in the selected symbols displayed on the display 54. At step 870, the prize awarder 628 then makes one or more awards corresponding to the winning symbol combination or combinations in the selected symbols (that is, the selected symbols for the last game instance) displayed on the display 54, if there is a winning symbol combination or combinations in the selected symbols displayed on the display 54.

If the symbol matcher 625 determines that the same symbol was displayed at a designated display position for the sequence of game instances at step 840, the symbol modifier 626 applies a symbol modification in respect of each designated display position (that is, a modification to the symbol for the last game instance displayed at each designated display position) where the same symbol was displayed to form a modified symbol display for the last game instance at step 850.

The prize awarder 628 then evaluates the modified symbol display to determine whether there is a winning symbol combination or combinations in the modified symbol display at step 860, and makes one or more awards corresponding to the winning symbol combination or combinations in the modified symbol display at step 870 if there is a winning symbol combination or combinations in the modified symbol display.

Example

In one example of the first embodiment where symbols are selected for display at each of two display areas, the gaming or "slot" machine has a symbol display comprising the following selected symbols (that is, symbols selected by the symbol selector 623 implemented by the processor 62 of the game controller 60 of the gaming machine) displayed at respective display positions of the two display areas:

1st display area:

| | | | | |
|---|---|---|---|---|
| A | B | C | D | E |
| C | D | E | A | B |
| B | A | E | D | C |

-continued

2nd display area:

| | | | | |
|---|---|---|---|---|
| C | D | E | A | B |
| C | B | A | E | D |
| B | D | A | E | C |

As indicated above, each display area comprises 3 rows by 5 columns of 15 symbol positions arranged in a rectangular matrix. In this embodiment, there are four designated display positions (indicated by underlined symbols above) in the display areas. At the upper left corner of each display area, there is a designated display position. There is another designated display position at the lower left corner of each display area. The upper left corner designated display positions of the two display areas correspond to one another. The lower left corner designated display positions of the two display areas correspond to one another.

As indicated above, at the lower left designated display positions of the two display areas, the selected symbols of the two display areas are the same. Thus, upon evaluation of the selected symbols by the symbol matcher 625 implemented by the processor 62 of the game controller 60 of the gaming machine, the symbol matcher 625 determines that the selected symbols for display at the lower left designated display positions of the two display areas are the same, and symbol modifier 626 implemented by the processor 62 of the game controller 60 of the gaming machine applies a modification to each of the selected symbols for display at each of the lower left designated display positions of the two display areas to form the following modified symbol display:

1st display area:

| | | | | |
|---|---|---|---|---|
| A | B | C | D | E |
| C | D | E | A | B |
| X | A | E | D | C |

2nd display area:

| | | | | |
|---|---|---|---|---|
| C | D | E | A | B |
| C | B | A | E | D |
| X | D | A | E | C |

As indicated above, the modification is to modify each of the selected symbols for display at each of the lower left designated display positions of the two display areas to a WILD symbol (indicated by an "X" above).

The prize awarder 628 implemented by the processor 62 of the game controller 60 of the gaming machine then evaluates the modified symbol display to determine whether or not there are one or more winning symbol combinations in the modified symbol display, and makes an award or awards corresponding to the winning symbol combinations if there are one or more winning symbol combinations in the modified symbol display.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art, will appreciate that program code provides a series of instructions executable by the processor.

It will be understood to persons skilled in the art of the invention that many modifications may be made without departing from the spirit and scope of the invention, in particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An electronic method of a gaming machine, the method comprising:

selecting, with an electronic game controller of the gaming machine based on one or more numbers generated by a hardware-implemented random number generator of the gaming machine, a first plurality of symbols for a first game instance;

selecting, with the electronic game controller based on the one or more numbers generated by the hardware-implemented random number generator and independently of the selecting of the first plurality of symbols, a second plurality of symbols for a second game instance;

displaying, via one or more displays of the gaming machine, the first plurality of symbols at a first plurality of display positions associated with the first game instance, and the second plurality of symbols at a second plurality of display positions associated with the second game instance;

evaluating, via the electronic game controller, the first plurality of symbols and the second plurality of symbols to determine whether a first symbol displayed at a first predetermined display position of the first plurality of display positions and a second symbol displayed at a second predetermined display position of the second plurality of display positions are a same symbol;

in response to determining that the first symbol and the second symbol are the same symbol, modifying, via the electronic game controller, the first plurality of symbols by replacing the first symbol at the first predetermined display position with a first replacement symbol, and modifying the second plurality of symbols by replacing the second symbol at the second predetermined display position with a second replacement symbol; and after the replacing, evaluating, with the electronic game controller, the first plurality of symbols to determine whether the first plurality of symbols for the first game instance includes one of a plurality of winning symbol combinations, and evaluating the second plurality of symbols to determine whether the second plurality of symbols for the second game instance includes one of the plurality of winning symbol combinations.

2. The method as claimed in claim 1, wherein the displaying comprises:

displaying the first plurality of symbols in a first display area of a first display of the one or more displays; and displaying the second plurality of symbols in a second display area of a second display of the one or more displays.

3. The method as claimed in claim 1, wherein the displaying comprises:

displaying the first plurality of symbols in a first display area of a display of the one or more displays; and displaying the second plurality of symbols in a second display area of the display, wherein the second display area is distinct from the first display area.

4. The method as claimed in claim 1, wherein the first predetermined display position and the second predetermined display position have a same relative position within their respective first and second plurality of display positions.

5. The method as claimed in claim 1, wherein:

the first predetermined display position is a first corner position of the first plurality of display positions;

the second predetermined display position is a second corner position of the second plurality of display positions; and the first corner position and the second corner position have a same relative position in their respective first and second plurality of display positions.

6. The method as claimed in claim 1, wherein:

the modifying the first symbol comprises selecting a first function symbol as the first replacement symbol; and the modifying the second symbol comprises selecting a second function symbol as the second replacement symbol.

7. The method as claimed in claim 6, wherein the first function symbol and the second function symbol are each a WILD symbol.

8. The method as claimed in claim 6, wherein the first function symbol is a first multiplier and the second function symbol is a second multiplier.

9. An electronic method of a gaming machine, the method comprising:

selecting, with an electronic game controller of the gaming machine based on one or more numbers generated by a hardware-implemented random number generator of the gaming machine, a first plurality of symbols for a first game instance in a sequence of game instances;

displaying, via one or more display of the gaming machine, the first plurality of symbols at a plurality of display positions;

selecting, with the electronic game controller based on the one or more numbers generated by the hardware-implemented random number generator and independently of the selecting of the first plurality of symbols, a second plurality of symbols for a second game instance in the sequence of game instances;

displaying, via the one or more displays, the second plurality of symbols at the plurality of display positions, replacing the first plurality of symbols displayed at the plurality of display positions;

evaluating, via the electronic game controller, the first plurality of symbols and the second plurality of symbols to determine whether a first symbol of the first plurality of symbols displayed at a predetermined display position of the plurality of display positions and a second symbol of the second plurality of symbols displayed at the predetermined display position are a same symbol;

in response to determining that the first symbol and the second symbol are the same symbol, modifying, via the electronic game controller, the second plurality of symbols by replacing the second symbol with a replacement symbol; and after the replacing, evaluating, with the electronic game controller, the second plurality of symbols for the second game instance in the sequence of game instances to determine whether the second plurality of symbols includes one of a plurality of winning symbol combinations.

10. The method as claimed in claim 9, wherein the predetermined display position is a corner position of the plurality of display positions.

11. The method as claimed in claim 9, wherein the replacement symbol comprises a function symbol.

12. The method as claimed in claim 11, wherein the function symbol is a WILD symbol.

13. The method as claimed in claim 11, wherein the function symbol is a multiplier.

14. A game controller for a gaming machine, the game controller, comprising:

a hardware-implemented random number generator;

a memory configured to store instructions; and a processor configured to execute the instructions stored in the memory, which when executed, cause the processor to at least:

select, based on one or more numbers generated by the hardware-implemented random number generator, a first plurality of symbols for a first game instance;

select, based on the one or more numbers generated by the hardware-implemented random number generator and independently of the first plurality of symbols, a second plurality of symbols for a second game instance;

display, via one or more displays of the gaming machine, the first plurality of symbols at a first plurality of display positions associated with the first game instance, and the second plurality of symbols at a second plurality of display positions associated with the second game instance;

evaluate the first plurality of symbols and the second plurality of symbols to determine whether a first symbol displayed at a first predetermined display position of the first plurality of display positions and a second symbol displayed at a second predetermined display position of the second plurality of display positions are a same symbol;

in response to determining that the first symbol and the second symbol are the same symbol, modifying the first plurality of symbols by replacing the first symbol at the first predetermined display position with a first replacement symbol, and modifying the second plurality of symbols by replacing the second symbol at the second predetermined display position with a second replacement symbol; and after the replacing, evaluate the first plurality of symbols to determine whether the first plurality of symbols for the first game instance includes one of a plurality of winning symbol combinations, and evaluate the second plurality of symbols to determine whether the second plurality of symbols for the second game instance includes one of the plurality of winning symbol combinations.

15. A game controller for a gaming machine, the game controller, comprising:

a hardware-implemented random number generator;

a memory configured to store instructions; and a processor configured to execute the instructions stored in the memory, which when executed, cause the processor to at least:

select, based on one or more numbers generated by the hardware-implemented random number generator, a first plurality of symbols for a first game instance in a sequence of game instances;

display, via one or more displays of the gaming machine, the first plurality of symbols at a plurality of display positions;

select, based on one or more numbers generated by the hardware-implemented random number generator and independently of the first plurality of symbols, a second plurality of symbols for a second game instance in the sequence of game instances;

display, via the one or more displays, the second plurality of symbols at the plurality of display positions, replacing the first plurality of symbols displayed at the plurality of display positions;

evaluate the first plurality of symbols and the second plurality of symbols to determine whether a first symbol of the first plurality of symbols displayed at a predetermined display position of the plurality of display positions and a second symbol of the second plurality of symbols displayed at the predetermined display position are a same symbol;

in response to determining that the first symbol and the second symbol are the same symbol, modifying the second plurality of symbols by replacing the second symbol with a replacement symbol; and after the replacing, evaluate the second plurality of symbols for the second game instance in the sequence of game instances to determine whether the second plurality of symbols includes one of a plurality of winning symbol combinations.

16. A gaming machine, comprising:

a display comprising a first display area and a second display area distinct from the first display area, the first display area having a first plurality of display positions including a first predetermined display position, and the second display area having a second plurality of display positions including a second predetermined display position; and a game controller configured to execute instructions stored in a memory, which when executed by the game controller, cause the game controller to at least:

select, based on one or more numbers generated by a hardware-implemented random number generator of the game controller, a first plurality of symbols for a first game instance;

select, based on one or more numbers generated by the hardware-implemented random number generator and independently of the first plurality of symbols, a second plurality of symbols for a second game instance;

display the first plurality of symbols at the first plurality of display positions;

display the second plurality of symbols at the second plurality of display positions;

evaluate the first plurality of symbols and the second plurality of symbols to determine whether a first symbol displayed at the first predetermined display position and a second symbol displayed at the second predetermined display position are a same symbol;

in response to determining that the first symbol and the second symbol are the same symbol, modify the first symbol at the first predetermined display position with a first replacement symbol, and modify the second plurality of symbols by replacing the second symbol at the second predetermined display position with a second replacement symbol; and after the replacing, evaluate the first plurality of symbols to determine whether the first plurality of symbols for the first game instance includes one of a plurality of winning symbol combinations, and evaluate the second plurality of symbols to determined whether the second plurality of symbols for the second game instance includes one of the plurality of winning symbol combinations.

17. The gaming machine as claimed in claim 16, wherein the first predetermined display position and the second predetermined display position have a same relative position within their respective first and second plurality of display positions.

18. The gaming machine as claimed in claim 16, further comprising:

a credit input mechanism configured to establish a credit balance in response to receiving a physical item associated with a credit value; and a payout mechanism configure to dispense credit from the credit balance;

wherein the game controller is further configured to adjust the credit balance based on wagers placed and prizes awarded for winning symbol combinations.

19. A gaming machine, comprising:

a display having a plurality of display positions including a predetermined display position; and a game controller configured to execute instructions stored in a memory, which when executed by the game controller, cause the game controller to at least:

select, based on one or more numbers generated by a hardware-implemented random number generator of the game controller, a first plurality of symbols for a first game instance in a sequence of game instances;

display the first plurality of symbols at the plurality of display positions;

select, based on the one or more numbers generated by the hardware-implemented random number generator and independently of the first plurality of symbols, a second plurality of symbols for a second game instance in the sequence of game instances;

display the second plurality of symbols at the plurality of display positions, replacing the first plurality of symbols at the plurality of display positions;

evaluate the first plurality of symbols and the second plurality of symbols to determine whether a first symbol of the first plurality of symbols displayed at the predetermined display position and a second symbol of the second plurality of symbols displayed at the predetermined display position are a same symbol;

in response to determining that the first symbol and the second symbol are the same symbol, modify the second plurality of symbols by replacing the second symbol a replacement symbols; and after the replacing, evaluate the second plurality of symbols for the second game instance in the sequence of game instances to determine whether the second plurality of symbols includes one of a plurality of winning symbol combinations.

20. The gaming machine as claimed in claim 19, wherein the predetermined display position is a corner position of the plurality of display positions.

* * * * *